United States Patent [19]

Ranzanigo

[11] 4,017,817

[45] Apr. 12, 1977

[54] FUSE STRIPS

[75] Inventor: Pierluigi Ranzanigo, Brescia, Italy

[73] Assignee: Bassani Ticino S.p.A., Milan, Italy

[22] Filed: July 9, 1975

[21] Appl. No.: 594,284

[30] Foreign Application Priority Data

July 16, 1974 Italy ..... 25194/74

[52] U.S. Cl. ..... 337/290; 337/159; 337/295

[51] Int. Cl.[2] ..... H01H 85/04

[58] Field of Search ..... 337/159, 160, 161, 290, 337/295, 296

[56] References Cited

UNITED STATES PATENTS

| | | | |
|---|---|---|---|
| 2,625,626 | 1/1953 | Matthysse | 337/159 |
| 2,747,257 | 5/1956 | Ashcroft et al. | 337/290 X |
| 3,147,355 | 9/1964 | Beau | 337/295 X |
| 3,317,691 | 5/1967 | Bassani | 335/159 |

*Primary Examiner*—J D Miller
*Assistant Examiner*—Fred E. Bell
*Attorney, Agent, or Firm*—Michael J. Striker

[57] ABSTRACT

A fuse strip used in protecting electrical circuits comprises an elongated strip-shaped body on which a plurality of polygonally-shaped apertures are spaced in the transverse direction. A current-carrying neck portion of uniform width is formed by respective longitudinal parallel sides of each adjacent pair of apertures, and a transverse band of uniform width is formed by two rows of apertures which are spaced in the longitudinal direction, each row of apertures having transverse sides which respectively lie on a common line extending in the transverse direction.

11 Claims, 2 Drawing Figures

FUSE STRIPS

BACKGROUND OF THE INVENTION

This invention relates to improvements in fuse strips for electric circuits, the strips being designed to interrupt the flow of current in the event of overload current or short circuit current. Fuse strips are known in the art and are generally enclosed in an insulating cylindrical cartridge and are connected to two conductive caps closing the ends of said insulating cartridge.

The known fuse strips are usually provided with a transverse row of juxtaposed apertures that delimits short reduced cross section elements or necks which are designed to melt under overload or short circuit current.

It is also known in the art to longitudinally space two transverse rows of said apertures so as to define a narrow transverse band therebetween. A low melting point alloy is poured on this band for forming with the copper material of the fuse strip a low melting point eutectic alloy. This latter arrangement is used particularly for ensuring an exact interruption of the fuse strips in the case of overload currents.

In the above discussed fuse strips, two main drawbacks are present. One drawback consists in the fact that the usual apertures on the transverse rows of the fuse strips are so shaped that the piercing punches, which are used to form them, rapidly wear and have to be changed frequently.

The other drawback consists in the fact that the band supporting the low melting point alloy, on account of the prior art apertures, presents an irregular width, so that said alloy may not be poured in a line of regular width. Moresaid said alloy, in the step of pouring and in the step of interrupting the fuse, has a tendency to run out of said band, so that the exact point of interruption is varied from one fuse strip to another, and consequently it is about impossible to repeat on an electrical circuit the same characteristics of the interruption.

SUMMARY OF THE INVENTION

According to the present invention, and for the end of overcoming these drawbacks, the apertures which form the necks in the fuse strips have a polygonal shape with beveled corners. The larger side of the polygonal apertures which extends transversely across the strips is constituted by a base directed across the strips, so that stonger piercing punches may be used which are more wear resistant.

Moreover the base extending transversely of the fuse strips allows the execution of each aperture row with the bases of each aperture disposed on a common, transverse straight line. Said apertures allow the interposition of very regular necks having a minimum cross section and also allow the formation of a transverse band for supporting the low melting point alloy in a very constant width. These features permit the pouring of a homogeneous, uniform alloy strip, thereby obtaining the same interruption characteristics for all the fuse strips, which is particularly useful in interrupting circuits under overload currents.

BRIEF DESCRIPTION OF THE DRAWING

An embodiment of the invention is now described with reference to the accompanying drawing, wherein.

DESCRIPTION OF THE PREFERRED EMBODIMENTS

Figure 1:
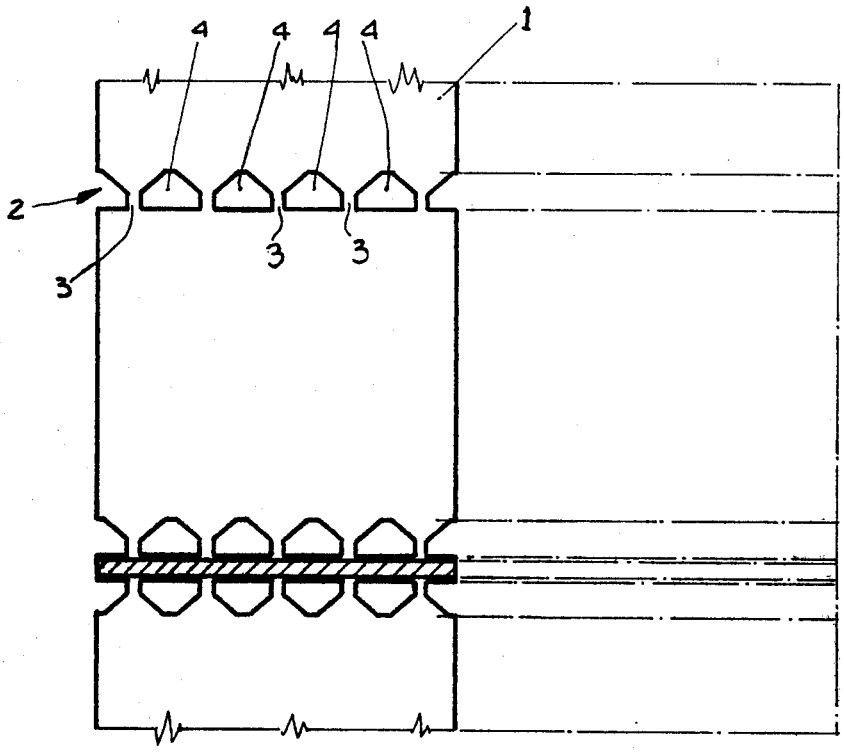
FIG. 1 shows, in a very enlarged scale, a portion of a fuse strip.

Referring now to FIG. 1, reference numeral 1 identifies a portion of a fuse strip, for example, constituted of copper, having a thickness and a width selected in dependence of a predetermined value of the nominal current of the electrical circuit.

Said fuse strip is provided with one or more regions 2 of reduced cross section, which are constituted by neck portions 3 interposed between apertures 4 spaced along a transverse line of the fuse strip.

According to the invention, said apertures 4 are shaped in an irregular polygonal form, but symmetrical with respect to their middle axis, and have their larger transversely-extending base 5 (FIG. 2) directed across the strip.

Preferably, the opposed sides 6 and 7 extend perpendicularly to the base 5, so that an interposed neck portion 3 has a substantially uniform cross section for the entire length of the sides 6 and 7. This neck, moreover, may be realized very narrowly, due to the fact that the apertures 4 may be arranged closely adjacent each other.

Figure 2:
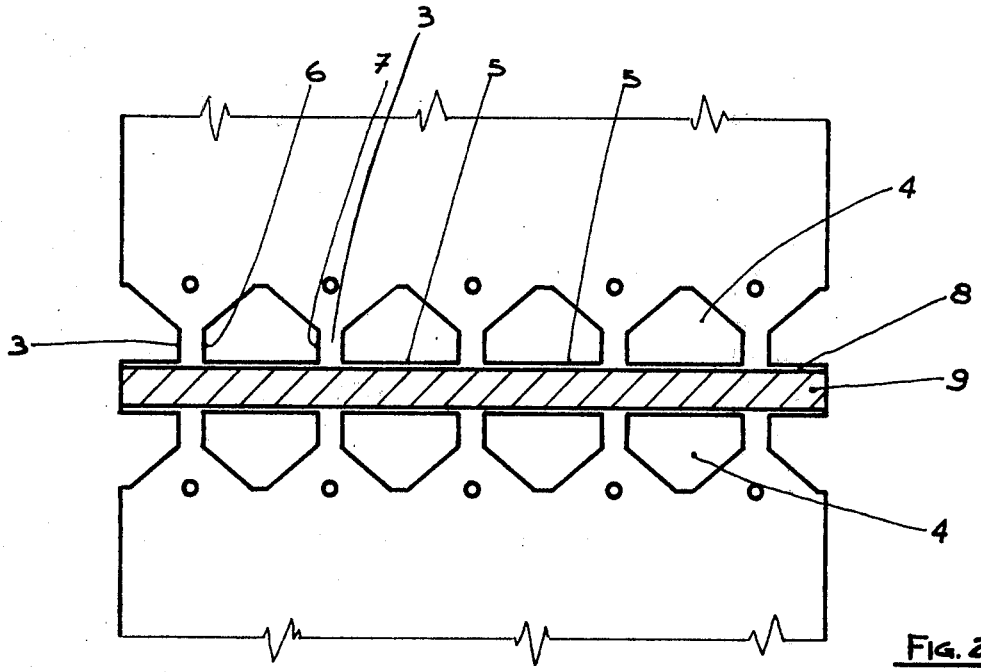
FIG. 2 shows, in a more enlarged scale, the portion of the fuse strip forming the transverse band holding the low melting point alloy.

As is more evident from FIG. 2, the polygonal apertures 4 have round or beveled corners and have a not-narrow shape so that the piercing punches, which are used for forming them, have a greater wear resistance than the punches usually employed to form apertures as in the prior art.

The feature of the bases 5 of larger width, spaced along a transverse row allows the disposal of all of the bases 5 on a common straight line.

This is advantageous because, in the formation of a transverse band 8, formed between two opposed aperture rows, said band 8 has a very constant width. Consequently, on said transverse band, a uniform width line 9 of a low melting point allow may be poured, thereby securing the constancy of the interruption characteristics in all the fuse strips produced.

I claim:

1. A fuse strip, particularly of the type used in protecting electrical circuits from overloads, comprising an elongated strip-shaped body; two spaced apart substantially parallel rows extending transversely of the elongation of said body, each row being composed of a plurality of apertures successive ones of which respectively delimiting with each other current-carrying portions; and a strip of fuse metal secured on said body in the space intermediate said rows, and overlying said body in direction transversely of the elongation of the latter so that each of said current-carrying portions is provided with substantially identical current-carrying capability.

2. A fuse strip as defined in claim 1, wherein said apertures are polygonally-shaped and have six sides, at least some of said sides being longer than others of said sides.

3. A fuse strip as defined in claim 1, wherein said apertures have a plurality of sides and rounded corners in the regions where the sides meet.

4. A fuse strip as defined in claim 1, wherein said longitudinal sides of each of said adjacent pairs of apertures are substantially normal to their respective transverse sides and are substantially parallel to each other so that the current-carrying portions have a substantially uniform width.

5. A fuse strip as defined in claim 1, wherein said fuse metal strip is substantially of uniform width transversely across the strip-shaped body.

6. A fuse strip as defined in claim 1, wherein said body is constituted of metallic material, and wherein said fuse metal has a melting point characteristic lower than that of said metallic body.

7. A fuse strip as defined in claim 1, wherein each of said apertures has a plurality of sides, each adjacent pair of apertures of a respective row having a longitudinal side which extends in direction of the elongation of said body and which bounds a respective one of said current-carrying portions.

8. A fuse strip as defined in claim 7, wherein each of said apertures of a respective row has a transverse side which all respectively lie on a common line which extends in direction transversely of the elongation of said body.

9. A fuse strip as defined in claim 1, wherein each of said apertures is symmetrical with respect to a longitudinal line bisecting the transverse side.

10. A method of making a fuse strip, particularly of the type used in protecting electrical circuits from overloads, comprising the steps of forming an elongated strip-shaped body with two spaced-apart substantially parallel rows which extend in direction transversely of the elongation of the body, each row being composed of a plurality of apertures successive ones of which respectively delimiting with each other current-carrying portions; and securing a strip of fuse metal on said body in the space intermediate said rows by overlying said body with said fuse metal strip in direction transversely of the elongation of said body so that each of said current-carrying portions is provided with substantially identical current-carrying capability.

11. A method as defined in claim 10, wherein said step of securing is performed by pouring said strip of fuse metal on said body.

* * * * *